US007461489B2

(12) United States Patent
Herbertsson

(10) Patent No.: US 7,461,489 B2
(45) Date of Patent: Dec. 9, 2008

(54) SYSTEM FOR SCREENING OFF AND A METHOD OF MOUNTING THEREOF

(75) Inventor: Ronny Herbertsson, Hillerstorp (SE)

(73) Assignee: Gunnebo Troax AB, Hillerstorp (SE)

( * ) Notice: Subject to any disclaimer, the term of this patent is extended or adjusted under 35 U.S.C. 154(b) by 557 days.

(21) Appl. No.: 10/517,484

(22) PCT Filed: Jun. 4, 2003

(86) PCT No.: PCT/SE03/00900

§ 371 (c)(1),
(2), (4) Date: Dec. 10, 2004

(87) PCT Pub. No.: WO03/106788

PCT Pub. Date: Dec. 24, 2003

(65) Prior Publication Data

US 2005/0210783 A1 Sep. 29, 2005

(30) Foreign Application Priority Data

Jun. 12, 2002 (SE) ..... 0201781

(51) Int. Cl.

| | |
|---|---|
| ***E04H 1/00*** | (2006.01) |
| ***E04H 17/16*** | (2006.01) |
| ***E04H 17/00*** | (2006.01) |
| ***E04C 3/00*** | (2006.01) |

(52) U.S. Cl. ..... 52/578; 52/238.1; 256/22; 256/24; 256/65.11

(58) Field of Classification Search ..... 52/578, 52/238.1; 256/22, 24, 65.11; 70/144; 411/191
See application file for complete search history.

(56) References Cited

U.S. PATENT DOCUMENTS

| | | | | | |
|---|---|---|---|---|---|
| 3,346,238 | A | * | 10/1967 | Dashio | 256/24 |
| 5,364,076 | A | | 11/1994 | Nicholls | |
| 5,372,354 | A | | 12/1994 | Cacicedo | |
| 5,974,842 | A | * | 11/1999 | Schlack et al. | 70/208 |

FOREIGN PATENT DOCUMENTS

| | | |
|---|---|---|
| GB | 1356059 | 6/1974 |
| NL | 1002257 | 10/1997 |

OTHER PUBLICATIONS

International Search Report from PCT/SE03/00900.

* cited by examiner

*Primary Examiner*—Richard E Chilcot, Jr.
*Assistant Examiner*—Mark R Wendell
(74) *Attorney, Agent, or Firm*—WRB-IP LLP

(57) ABSTRACT

In a system for screening off an area, a partition element substantially covers the space between two upstanding carrier elements. The partition element is catchable in the carrier elements in a temporary, unstable preparatory position. The partition element lacks the capability of remaining in the preparatory position by its own force. The partition element is further movable from the preparatory position to a fixedly locked position in the carrier elements. In a method of mounting and dismounting of a partition element on two upstanding carrier elements, the partition element is hooked in the carrier elements in the preparatory position. Thereafter, the partition element is moved to a fixedly locked position in the carrier elements.

19 Claims, 3 Drawing Sheets

SYSTEM FOR SCREENING OFF AND A METHOD OF MOUNTING THEREOF

TECHNICAL FEILD

The present invention relates to a system for screening off an area, a partition element substantially covering a space between two upstanding carrier elements.

The present invention further relates to a method in the mounting and dismounting of a partition element on two upstanding carrier elements.

BACKGROUND ART

In industry, machines which in one respect or another constitute a hazard are common. In order to protect people, and in some cases also objects, in the ambient environment, there are various types of machine guards. A common type of machine guard is that the area around the machine is screened off. The screening off may be such that people are prevented from entering into the working area of the machine while it is in operation, that the screening off arrests objects which are flung out by mistake, that the screening off prevents spattering or flying jets of liquid, that the screening off impedes troublesome light, such as UV radiation in welding, as well as other types of screening off arrangements.

Regardless of what the screening off arrangement is meant to protect against, there are a number of common safety requirements. The essential point of departure of these requirements is that the screening off arrangement should not be passable without the consequences thereof first being considered. Another safety requirement is that the screening off arrangement cannot be left in the open state unintentionally, so that it is later disturbed during operation by the machine which is being screened off.

There are also certain convenience aspects which it is desirable that the screening off arrangement satisfies. The mounting (and possibly also dismounting) of the screening off arrangement should be as rapid and simple as possible without disregarding safety requirements. Existing screening off arrangements are generally mounted on upstanding posts. The screening off partition elements are generally screwed in place, either directly in the post or via a fitting of some type. Such an assembly is quite complicated and time-consuming, since only one screw can be tightened at a time and, as a result, the partition element must be held in position while the first screws are mounted. Correspondingly, the dismounting of the partition element, where applicable, is a complicated operation, even though it is possible per se.

Problem Structure

There is thus a need in the art to be able to realise a screening off arrangement which is simple to mount and dismount, but at the same time satisfies requirements on safety in order to prevent unintentional access to a screened off machine and consequential accidents.

Solution

The object forming the basis of the present invention will be attained if the system intimated by way of introduction is characterised in that the partition elements are hookable in the carrier elements in an unstable preparatory position, where the system lacks the capability of remaining in position by its own force, and is movable therefrom to a fixedly locked position in the carrier elements.

Further advantages will be attained if the system is moreover given one or more of the characterising features as set forth in the appended claims 2 to 10.

Regarding the method, the object according to the invention will be attained if this is given the characterising feature that the partition element is hooked in the carrier element in a temporary, unstable preparatory position and is thereafter moved to a fixedly locked position in the carrier elements.

Further advantages will be attained regarding the method if this is given one or more of the characterising features as set forth in appended claims 12 to 13.

BRIEF DESCRIPTION OF THE ACCOMPANYING DRAWINGS

The present invention will now be described in greater detail hereinbelow, with reference to the accompanying Drawings. In the accompanying Drawings.

DESCRIPTION OF PREFERRED EMBODIMENT

Figure 1:
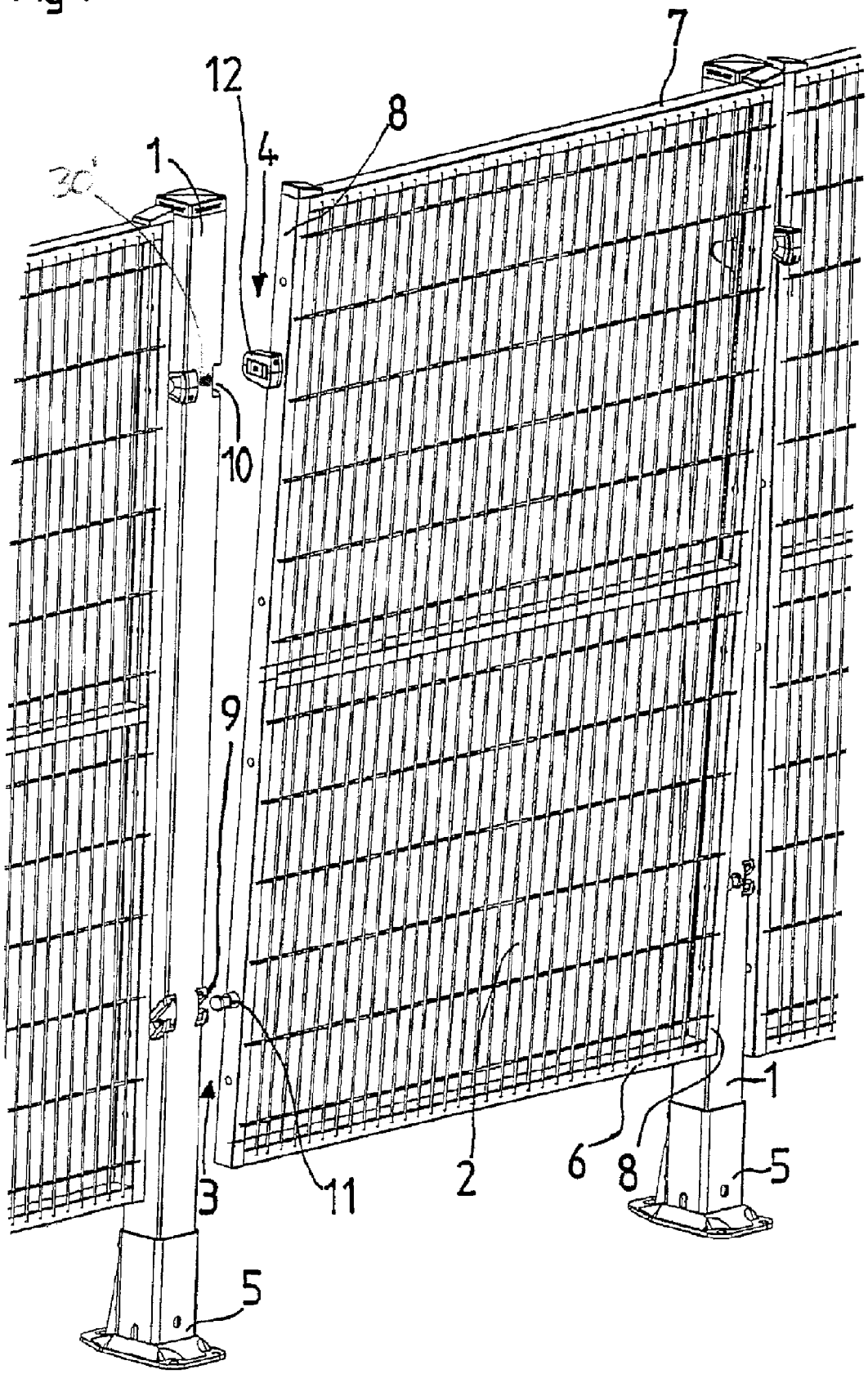
FIG. 1 is a perspective view of the system according to the present invention in the mounting thereof.

FIG. 1 shows the system for screening off according to the present invention. In rough outline, the system includes a number of carrier elements 1 in the form of posts, a number of partition elements 2 intended to be disposed between the carrier elements 1 and be supported thereby, as well as a number of anchorage devices 3, 4 for realising the interconnection between the carrier elements and the partition elements.

The carrier elements 1 which, in the preferred embodiment, consist of posts, are anchored in the substrate. In the Figure, the anchorage elements 5 are shown as sleeves disposed outside the posts 1 and having a foot which is fixable by means of bolts in the substrate, typically a concrete floor. This type of anchorage element 5 is adjustable, which is an advantage in the event of an uneven floor surface. Anchorage elements also occur on the market which are fixedly welded on the post or which constitute an integral part of it.

The carrier elements 1 are substantially parallel with one another and typically are substantially vertical. Since the partition elements 2 which are to be mounted between the carrier elements 1 are substantially rectangular with predetermined dimensions, it is important that the distance between the carrier elements 1 agrees with the outer dimensions of the partition elements 2. The carrier elements 1 extend substantially throughout the entire height of the screening off system and are an integral part thereof.

Like the carrier elements 1, the partition elements 2 also extend along the greater part of the height of the screening off system. However, it does occur, as shown in FIG. 1, that a small space is left between the lower edge of the partition elements 2 and the floor. However, this space may not be so large that people occupying the premises where the screening off system is employed are tempted to crawl under the lower edge 6 of the partition element 2 in order to gain access to the screened off equipment.

The main section of the partition element 2, i.e. the region between its outer edges, is of substantially planar extent. The main section consists, in FIG. 1, of a grid but may, as was mentioned by way of introduction, also be plexiglass, sheet metal, sound damping material or the like. A transparent material may advantageously be toned or coloured in order not to allow the passage of harmful UV radiation. A feature common to the different types of materials included in the partition elements 2 is that they are durable and expedient for the type of protection which is to be afforded. The outer edges 6, 7, 8 of the partition elements 2 consist, in the preferred embodiment, of tubes of substantially rectangular cross section.

There are disposed lower 3 and upper 4 anchorage devices in the side edges 8 of the partition elements 2. The lower anchorage devices 3 are pairwise disposed flush with one another so that they define a spatial pivotal axis around which the partition elements 2 are pivotal. The upper anchorage devices 4 are similarly disposed in pairs, i.e. one anchorage device 4 on each side of the partition element 2. In the carrier elements 1, there are provided lower 9 and upper 10 recesses which are disposed to accommodate each respective anchorage device 3, 4. In the lower recess, there is provided a separate lining with a groove for receiving each respective lower anchorage device 3. The upper recess 10 is disposed to receive in itself each respective upper anchorage device 4. The lower anchorage devices 3 comprise laterally projecting projections or pins 11 which are disposed to be inserted in the lower recesses 9 which incline downwards and inwards in the carrier element 1. The upper anchorage devices 4 include locking means 12 which are disposed to retain the entire partition element 2 in a locked position between the carrier elements 1.

The mounting of the screening system takes place as follows: the carrier elements 1 in the form of posts are mounted on the floor in a conventional manner. In such instance, it is ensured that the posts 1 are substantially vertical and are disposed at uniform spacing from one another, this spacing substantially corresponding to the width of the partition elements 2.

A partition element 2 is then lifted upwards so that the projections or pins 11 are located flush with the lower recesses 9. The projections 11 are passed into the upper, open ends of the recesses 9 and are then permitted to slide downwards towards the bottom of each respective recess 9. Typically, the projections 11 are inserted in each respective recess 9 substantially simultaneously, but in general the tolerance in the construction is such that it is possible to insert them one at a time into the recesses 9. During this procedure, the partition elements 2 may be located in an upright position, but this is, however, not entirely necessary.

In that the projections 11 are placed in the recesses 9, the partition element 2 has been aligned around a substantially horizontal axis which is defined by and extends through the projections 11. Hence, the partition element 2 is pivotal around the projection 11 and the axis defined by them. The weight of the partition element is now principally supported by the projections 11. However, this depends on the angle of the partition element 2 in relation to the vertical plane which is supported by the carrier elements 1. The greater this angle is, the greater part of the weight must be supported by manually supporting the upper region of the partition element 2. In that case when the partition element 2 is as good as vertical, only minimal manual support is required to keep the partition element 2 upright. However, the partition element is not in a stable position, for which reason it is not possible to leave the partition element 2 in this unstable so-called preparatory state or position, but it is necessary instead either to open the screening system completely or to lock the partition element 2 in position in the carrier elements 1.

To fixedly lock the partition element 2 in the carrier elements 1, the partition element 2 is quite simply pressed against the carrier elements in their upper end so that the locking means 12 are inserted in the upper recesses 10. The locking means 12 have a snap function, with the result that they are snapped in place in the recesses 10 when being inserted therein. The locking means must subsequently be activated by a special tool in order for the partition elements 2 once again to be released. The employment of a separate special tool is a requirement in the valid standards applicable to machine safety. The tool must not be totally unique, but should be a tool of the type not always carried by all of those working around the machine.

The above-outlined method of mounting the screening off systems is both simple and rapid. The precision that is necessary is largely integrated in the carrier elements 1 and the partition elements 2 already on manufacture. The only requirement on mounting on site is that the carrier elements 1 must, in the customary manner, be mounted so that they are substantially vertical and are located in spaced apart relationship from one another corresponding to the structural dimensions of the partition element 2. The centre distance between the posts 1 thus exceeds the width of the partition element 2, since account must also be taken of the spatial extent of the posts 1 and the projections 11, respectively. A further advantage inherent in this method is that it affords ergonomic advantages for the personnel mounting the system, since the partition element 2 can rapidly be brought to a position where the greater part of its weight is carried in the lower recesses 9.

Figure 2:
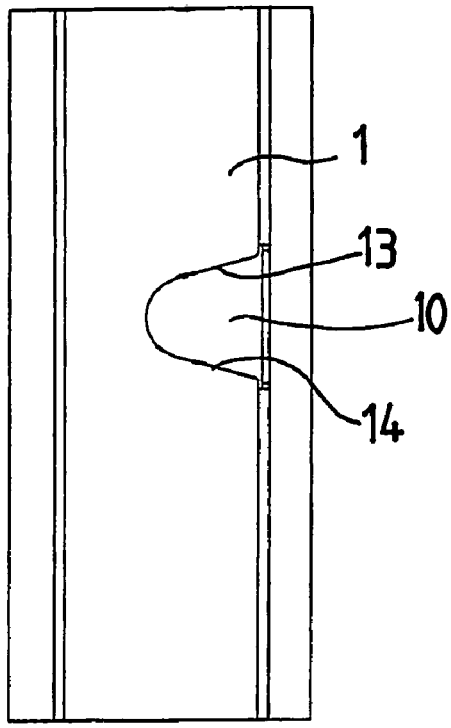
FIG. 2 is a straight side elevation of an upper recess in a carrier element included in the present invention.

FIG. 2 shows an upper recess 10 in a carrier element 1 in detail from the side. The recess 10 is substantially in the form of a short wedge, but with a snub-nosed end. The upper 13 and lower 14 edges of the recess display an inclination which permits the partition element 2 with the locking means 12 to be pivoted in place in the recess. In such instance, the locking means 12 will follow the periphery of a circle whose centre point lies in the subjacent projection 11. The configuration of the recess is complementary to the configuration of a guide portion in the locking means 12 so that it is possible to move the guide means 12 in position in the recess 10. The recess 10 is shown in FIG. 2 straight from the side, but it is in all likelihood apparent from FIG. 1 that the recess also displays an extent at right angles to the plane of the Drawing paper in FIG. 2.

Figure 3:
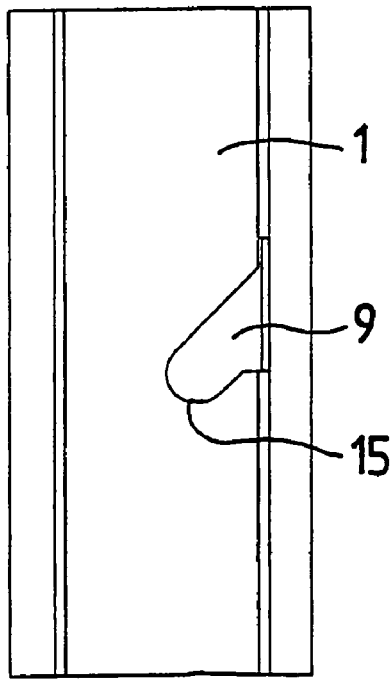
FIG. 3 is a straight side elevation of a lower recess in a carrier element included in the present invention.

FIG. 3 shows a lower recess 9 in a carrier element 1 straight from the side. The recess substantially displays the configuration of an inclined groove whose bottom 15 is disposed below its opening. Objects, such as a projection 11, inserted in the recess 9 will, in this instance, show a tendency to move towards the bottom 15 of the groove by force of gravity. The distance between the opening of the groove and its bottom 15, i.e. the depth of the groove, is so great that the partition element 2 cannot be pivoted outwards at the bottom in the fixedly locked position. Like the recess 10, the recess 9 is also of an extent spatially at right angles to the plane of the Drawing paper in FIG. 3.

The recess 9 is disposed to be provided with an insert or a lining so as to improve its properties in various respects, for example the guiding of the projection 11 in the recess 10.

Figure 4:
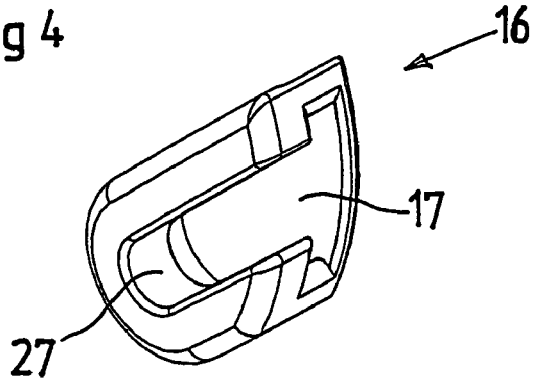
FIG. 4 is a perspective view of an accommodation device for mounting in the lower recess according to FIG. 3.

FIG. 4 is a perspective view of a lining 16 for insertion in the lower recess 9. The outer contours of the lining 16 correspond to the contours of the lower recess 9, so that the lining 16 can be inserted in it. In order that the lining 16 remain in position in the recess 9, it is provided, on its side facing away from the observer of the Drawing, with a projection or a bead which permits the lining 16 to be moved into position in the recess 9 but does not allow it to be removed therefrom. Naturally, the projection may be disposed on any other part of the lining 16 facing towards the recess 9. Thus, the fit in the recess 9 is good. The lining 16 is manufactured from a suitable material which, on the one hand, displays a relatively low friction coefficient and, on the other hand, displays a certain degree of elasticity. A low friction coefficient entails that the projection 11 of the partition element 2 readily slides in the lining 16 and assumes its position. The elasticity properties should be selected so that they contribute to a reduction in noise both on mounting and in the event of possible vibrations from the screened off equipment or neighbouring equipment.

Like the recess 9, the lining 16 has a groove 17 for accommodating the projections 11. In the preferred embodiment, the groove has a T-shaped cross section and can, as a result, accommodate the head of a pin of corresponding configuration. The groove 17 has a rounded bottom 27 which permits pivoting of the partition element 2 to the desired position.

The lining 16 also has a circumferential groove (not shown) for accommodating the edge of the recess 9 in the region of the bottom 15 and 27, respectively, of the recess 9 and the groove 17, i.e. on the outside of the lining 16.

Figure 5:
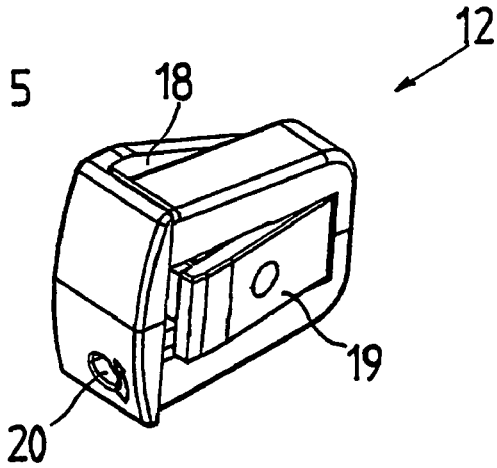
FIG. 5 is a perspective view of a locking member for mounting in the upper recess according to FIG. 2.

FIG. 5 is a perspective view of the locking means 12. The locking means 12 displays a guide section 18 in the form of a groove for accommodating the edges 13, 14 of the upper recess 10. The bottom of the groove 18 is of a configuration which is complementary to the configuration of the edges 13, 14 of the upper recess. The locking means 12 further displays a snap catch in the form of a spring 19. That end of the spring 19 which is most proximal the outwardly facing side of the locking means 12 projects out a distance from the main portion of the locking means 12, while the rear end of the spring 19 lies substantially flush with the main portion of the locking means 12. This implies that, when the locking means 12 is inserted in the recess 10, the spring 19 will be depressed during insertion in order subsequently to spring out and fixedly lock the locking means 12 in its position.

In order to release the locking means 12, an actuator device 30 is disposed therein. The actuator device 30 is operable by means of a special tool, for example an Allen key. The dimension of the Allen key which is required may be selected so that the tool can hardly be replaced by any other tool. By such means, it is ensured that the locking means 12 and, thereby, the screening off system, cannot be opened unintentionally. The actuator device 30 acts on the spring 19 so that its forward region is retractable in the locking means 12.

Figure 6:
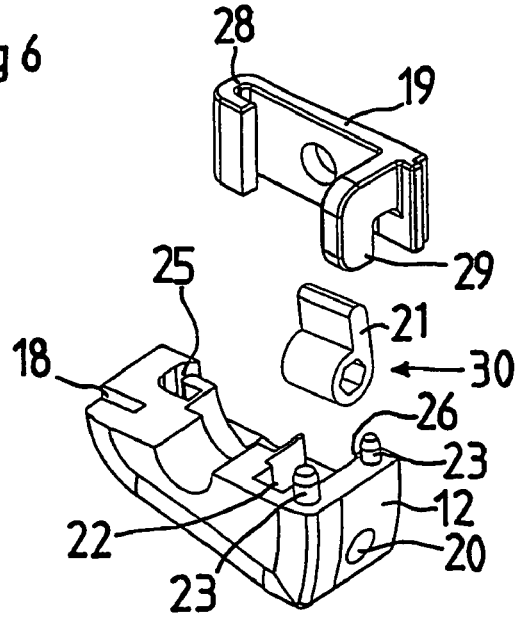
FIG. 6 is an exploded view of the locking member according to FIG. 5.

FIG. 6 is an exploded view of the locking means 12. The view in FIG. 6 shows the opposite side of the locking means 12 compared with FIG. 5. The locking means 12 has been cut away so that only its lower half is shown. In practice, the locking means 12 is manufactured in two halves which are retrofitted. Two pins 23 are provided in the forward portion of the locking means 12 for interconnection with corresponding holes in the other half of the locking means 12.

Uppermost in FIG. 6, there is shown the spring 19 included in the locking means 12. Its rear end 28 has a hook-like configuration for fixing of the spring 19 in the locking means 12. Its forward end has a catch 29 for cooperation with the actuator device 30.

The actuator device 30 includes a rotary excenter or sleeve with a projection or a vane 21. The vane 21 is disposed for direct contact with the catch 29 and to draw this inwards when the excenter or sleeve is rotated.

In the main portion of the locking means 12, there is disposed a recess 25 for accommodating the rear end 28 of the spring 19. The recess 25 is of a configuration which is complementary to the rear end 28.

The excenter or sleeve is disposed centrally in the locking means 12 so that it is externally rotary as a part of the actuator device 30. The post 1 is advantageously provided with holes on its side turned to face away from the observer of FIG. 1, and the locking means 12 is provided in a corresponding manner with rear holes for access of the actuator device 30. It is thus possible to open the screening system from its inside as well.

A recess 22 is provided in the locking means 12 adjacent the excenter 30 for temporarily receiving the catch 29 when this is drawn inwards. Correspondingly, there is provided a recess 26 in the side of the locking means 12 for receiving the spring 19 in its retracted position.

DESCRIPTION OF ALTERNATIVE EMBODIMENTS

The present invention may be modified in a number of respects. One method of modifying the present invention is to cause the spring 19 to be of one piece manufacture with the locking means 12 instead of, as in the above-described embodiment, being a separately manufactured part.

Another method of modifying the present invention is to place the actuator device 30' outside the locking means 12, i.e. somewhere in the carrier element 1. In this embodiment, actuation of the spring is preferably put into effect in that this is urged inwards towards the locking means rather than being subjected to inward tractive forces.

In the preferred embodiment, it was described how the projections 11 and the locking means 12 are disposed on side edges 8 of the partition element 2, and that the recesses 9 and 10 are disposed in the carrier elements 1. Naturally, it is conceivable to modify the construction so that the recesses are disposed in the side edges 8 of the partition element 2, while the locking means 12 and the projections 11 are disposed in the carrier elements 1.

Yet a further method of modifying the present invention is, when particularly tall screening off systems are to be constructed, to dispose the partition elements 2 vertically superposed above one another. An upper partition element 2 could then be pivotal around its lower edge 6, i.e. the lower anchorage devices 3 are disposed at the transition between a lower and an upper partition element.

The present invention may be further modified without departing from the scope of the appended claims.

What is claimed is:

1. A system for screening off an area, comprising a partition element substantially covering a space between two upstanding carrier elements, the partition element being connected to the carrier elements in an unstable preparatory position in which preparatory position the partition element is unable to remain unaided, and from which preparatory position the partition element is pivotable to a fixedly locked position relative to the carrier elements, wherein the partition element includes a lock, each lock comprising a guide section for interlocking engagement with a recess in a respective carrier element of the carrier elements, the guide section being receivable in the recess in a direction of pivoting of the partition element, and each lock comprising a snap catch for retaining the guide section relative to the carrier element and the partition element in the fixedly locked position relative to the carrier elements, the snap catch being depressable during insertion of the guide section in the recess and the snap catch being retractable in the lock by a specially adapted tool, and the snap catch being retractable by a sleeve with a vane on rotating the sleeve with the tool.

2. The system as claimed in claim 1, wherein the partition element includes two pins which are disposed in a groove in each respective carrier element or vice versa, in the preparatory position.

3. The system as claimed in claim 2, wherein the groove is undercut and the associated pin displays a complementary configuration.

4. The system as claimed in claim 2, wherein the groove inclines obliquely downwards so that the pins are retained therein in the fixedly locked position in the carrier elements.

5. The system as claimed in claim 4, wherein the groove is undercut and the associated pin displays a complementary configuration.

6. The system as claimed in claim 4, wherein the depth of the groove is greater than the diameter of the pins, so that these are retained in each respective groove in the fixedly locked position.

7. The system as claimed in claim 1, wherein the snap catch includes a spring element which is actuable by an actuator device for releasing the lock.

8. The system as claimed in claim 7, wherein the actuator device is disposed substantially inside the lock.

9. The system as claimed in claim 7, wherein the actuator device is disposed substantially outside the lock.

10. The system as claimed in claim 9, wherein the actuator device is disposed in the carrier element.

11. A method for mounting a partition element on two upstanding carrier elements, comprising hooking the partition element in the carrier elements in a temporary, unstable preparatory position, moving the partition element to a stable, mounted position relative to the carrier elements, locking the partition element in the mounted position by depressing a snap catch on each side of the partition element while moving the partition element to the mounted position so that the snap catch is received in a recess in a direction of movement of the partition element to the mounted position and so that the snap catch springs out into a locking position for fixedly locking the partition element relative to the carrier elements when in the mounted position, and retracting each snap catch by operating an actuator element to permit removal of the partition element from the carrier elements.

12. The method as claimed in claim 11, wherein an actuator device is operated by a special, separate tool.

13. The method as claimed in claim 11, wherein the partition element is locked relative to the carrier elements by pressing the partition element against the carrier elements.

14. The method as claimed in claim 13, wherein an actuator device is activated by a special, separate tool for releasing the partition element from the fixedly locked position.

15. A system for screening off an area, comprising:

two upstanding carrier elements;

a partition element substantially covering a space between the two upstanding carrier elements, the partition element being connectable to the carrier elements in an unstable preparatory position in which preparatory position the partition element is unable to remain unaided and from which preparatory position the partition element is movable to a fixedly locked position relative to the carrier elements;

at least one lock, the at least one lock comprising a guide section for interlocking engagement with a recess and a snap catch movable to an extended position for retaining the guide section in the recess to lock the partition element in the fixedly locked position relative to the carrier elements, the guide section being received in the recess in a direction of movement of the partition element toward the fixedly locked position, the snap catch being movable to a retracted position during insertion of the guide section in the recess, and a rotatable sleeve with a vane being provided to move the snap catch to the retracted position upon rotation of the sleeve through action of the vane on the snap catch.

16. A system for screening off an area, comprising:

a first and a second upstanding carrier element defining a space therebetween;

a partition element removably connected at first and second sides thereof to the first and second carrier elements, respectively, the partition element being pivotably attachable to the first and second carrier elements by an attachment arrangement and lockable in a fixed position by a lock arrangement, a face of the partition element being parallel to longitudinal directions of the first and second carrier elements when the partition element is in the fixed position;

the attachment arrangement comprising a recess extending in a direction perpendicular to the face of the partition element and a pin, the attachment arrangement permitting pivoting of the partition element relative to the first and second carrier elements about the pin when the lock is in an unlocked condition; and the lock arrangement being disposed vertically above the attachment arrangement and including a first recessed component and a second non-recessed component receivable in the recessed component in a direction of pivoting of the partition element for locking the partition element in the fixed position when the partition element is pivoted about the pin to the fixed position.

17. The system as set forth in claim 16, wherein the pin extends from the partition element and the recess is provided in the first and second carrier elements.

18. The system as set forth in claim 16, wherein the lock comprises a snap lock.

19. The system as set forth in claim 16, wherein the non-recessed component is provided on the partition element and the recessed component is provided on the first and second carrier elements.

* * * * *